United States Patent [19]

Winfield

[11] 4,224,747

[45] Sep. 30, 1980

[54] MOCCASIN CUSHIONED SOLE

[76] Inventor: Sidney Winfield, 55 Hickory Dr., Roslyn, N.Y. 11576

[21] Appl. No.: 2,463

[22] Filed: Jan. 10, 1979

[51] Int. Cl.[2] ..... A43B 3/14; A43B 13/12

[52] U.S. Cl. ..... 36/11; 36/30 R; 12/142 MC

[58] Field of Search ..... 36/11, 30 R, 69; 12/142 MC

[56] References Cited

U.S. PATENT DOCUMENTS

| | | | |
|---|---|---|---|
| 2,212,610 | 8/1940 | Lyness | 36/11 |
| 2,438,321 | 3/1948 | Maling | 36/11 |
| 2,724,912 | 11/1955 | Silombra | 36/30 R |
| 3,938,265 | 2/1976 | Pröbstl et al. | 36/11 |

FOREIGN PATENT DOCUMENTS

| | | | |
|---|---|---|---|
| 1141113 | 3/1957 | France | 36/11 |
| 563258 | 4/1944 | United Kingdom | 36/30 R |

*Primary Examiner*—James Kee Chi

*Attorney, Agent, or Firm*—Ostrolenk, Faber, Gerb & Soffen

[57] ABSTRACT

A moccasin having a continuous vamp defining the insole beneath the foot and the sides of the moccasin. The vamp is connected to the upper at the top of the moccasin. The moccasin has a wear and scuff resistant outer sole, which includes an integral side wall that extends up to and is secured to the sides of the vamp. The outer sole is shaped by a midsole which is secured therein. A full cushion pad, extending toe to heel is provided between the midsole and the underside of the vamp of the moccasin. In addition, a heel cushion pad of substantially the same thickness as the full cushion pad is provided between the full cushion pad and the heel portion of the underside of the vamp. The heel cushion pad is skived at its front end to avoid any ridge which might be annoying to the foot. The full advantage of the cushioned softness and feel of a moccasin is achieved while wear resistance and protection against ground texture and hazards are provided.

6 Claims, 3 Drawing Figures

MOCCASIN CUSHIONED SOLE

The present invention relates to moccasins, and is of particular value for hand sewn moccasins. The invention specifically concerns a special cushioned sole construction that results in the softest and most comfortable shoe afoot.

BACKGROUND OF THE INVENTION

The characteristic feature of the type of footwear construction called a moccasin is that the vamp is continuous and integral and extends beneath the foot and is also wrapped up the side, front and back. Appropriate finishing at the ankle entry and heel of the moccasin is provided by appropriate finishing seams. An appropriate top piece or upper is provided at the front of the moccasin, is attached at the top of the vamp, preferably by hand sewing, and extends over the instep and the toes. Moccasins customarily do not provide very soft support beneath the foot, for they are generally made with soles of harder leather, and unlike the original moccasin, they frequently have rubber or leather heels attached to the sole.

To protect the underside of the vamp so it can withstand the scuffing and wear normally applied to a sole, it is customary to reinforce the sole in various ways or cover it with a thick, relative hard outer sole. Such reinforcement of the sole or beneath the lower surface of the vamp of the moccasin reduces the softness of the moccasin as the wearer walks.

Various means have been utilized for providing soft pads or auxiliary cushion soles for various types of footwear, including sandals and shoes, in which the upper is separate from the insole or the portion that passes under and in contact with the foot. An arrangemment that softens the feel of moccasins as the wearer walks is not similarly known. Thus, Peterson, U.S. Pat. No. 2,680,309 shows a sandal consisting of a platform with lace supports for the platform. Meltzer, U.S. Pat. No. 2,342,882 also shows a platfom structure for a sandal. Other U.S. patents of interest which show various attempts to provide comfort in shoes are Alianiello, U.S. Pat. No. 2,502,774; Andresen, U.S. Pat. No. 2,222,391; Gilkerson, U.S. Pat. No. 1,852,238; Greider, U.S. Pat. No. 2,156,532; Colman, U.S. Pat. No. 3,172,217; McIntyre, U.S. Pat. No. 897,920; Auerback, U.S. Pat. No. 2,160,692; and Gilkerson, U.S. Pat. No. 1,751,990.

Despite all these attempts to solve the problem of foot comfort and solf feeling in rigid shoes, no comparable softening of a moccasin has apparently been attempted.

SUMMARY OF THE INVENTION

The primary object of the present invention is to provide a moccasin which is comfortable to walk on.

It is another object of the invention to provide a moccasin having a sole which is wear and scuff resistant and which is hard enough to withstand normal ground hazards, while at the same time endeavoring to enhance comfort for the wearer of the moccasin.

The present invention provides a moccasin sole that substantially enhances the comfort inherent in a moccasin construction. At the same time, the sole resists wear and abrasion. One reson for this is that the sole is hard enough on its underside so as not to be damaged by normal ground hazards and so as not to transmit sensation of these hazards to the wearer's foot. At the same time, the sole resists wear and abrasion because the cushion pads add resiliency and result in a broader distribution of the wearer's weight, thereby reducing spot pressure and the resiliency further decreases the friction on the sole.

Thus, the underside of the continuous vamp of the moccasin, which also serves as the inside of the moccasin, is covered by an underside construction. According to the present invention, there is an outer sole which contacts the ground and is of a size sufficient for it to be turned up at the edges to cup and engage the sides of the vamp of the moccasin. The outer sole is made of material capable of resisting abrasion and wear.

To rigidify the moccasin, to protect the wearer's foot against ground hazards and to give the sole of the moccasin the contour of the wearer's foot, a relatively rigid midsole is positioned between the outer sole and the lower surface of the vamp of the moccasin and adjacent the outer sole. To enhance wearer comfort, a full foot cushion pad, of sufficient thickness to assure wearer comfort, is placed between the lower surface of the vamp and the midsole. To raise the wearer's heel, on top of the cushioned sole pad, there is placed an additional heel pad, cut to conform to the general shape of the heel portion of the moccasin and of the same general thickness as the cushioned sole pad. The forward end of the heel pad is skived to merge smoothly with the full sole pad and to not provide any ridge or welt which can be sensed by the foot through the relatively thin surface of the lower portion of the vamp of the moccasin.

The pads just mentioned may be comprised of natural or synthetic foam rubber, felt, down or any other natural or synthetic material that will add resiliency, flexibility and softness to the cushion pads.

The foregoing structure has all of the comfort of a moccasin, together with the resistance to scuff and wear which the outer sole can provide, coupled with the support and rigidity provided by the midsole for the outer sole and coupled also with the comfort provided first by the full sole pad above the midsole and also by the heel pad at the heel section between the lower surface of the vamp and the full sole pad.

This new special cushioned sole construction gives the wearer a cushioned softness combined with the gentle feel of a moccasin that is not available in any other type of footwear. In addition, this special sole construction provides wear resistance and protection against ground texture and hazards.

BRIEF DESCRIPTION OF THE DRAWINGS

The foregoing and other objects and features of the present invention will become apparent in the following description and accompanying drawings in which.

DESCRIPTION OF A PREFERRED EMBODIMENT

Figure 1:
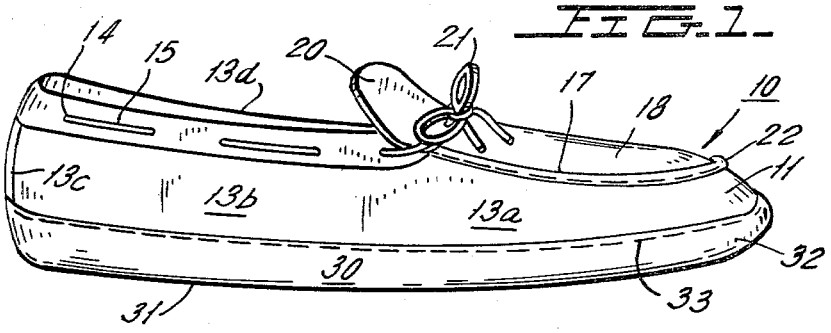
FIG. 1 is a perspective view of the moccasin of the present invention.
Figure 2:
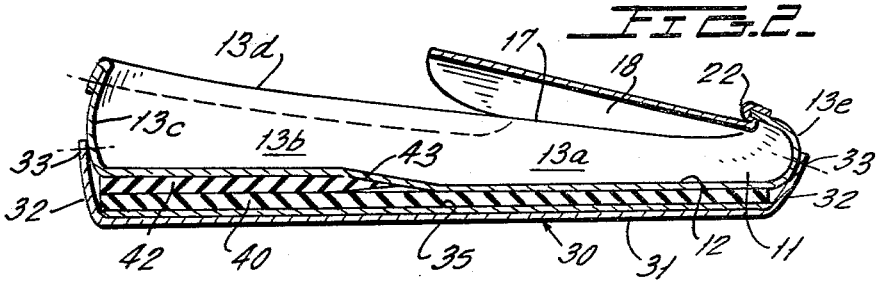
FIG. 2 is a longitudinal cross-sectional view of the moccasin of FIG. 1.
Figure 3:
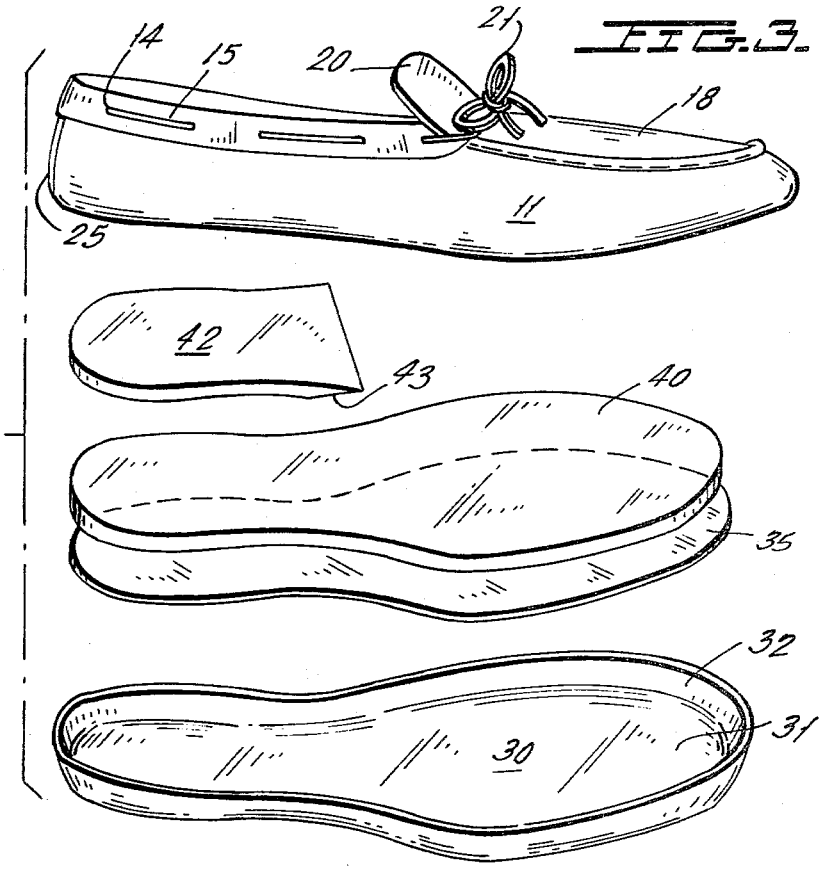
FIG. 3 is an exploded view showing, from top to bottom, the continuous vamp of the moccasin, the skived heel pad, the fulll sole pad, the full midsole and the outer sole.

Referring to the Figures, the moccasin 10 includes the continuous vamp 11 comprised of a bottom surface 12 which is continuous and integral with the folded up side portions 13*a* at the front of the moccasin and the folded up side portions 13*b* at the rear of the moccasin. The side portions 13*b* at the rear of the moccasin are carried up around the heel section 13*c* to the finishing collar 13*d* which may be sewn in any desired ornamental pattern and which may also be provided with eyelets 14 for the laces 15.

The upper edge of the folded up side portions 13*a* of the vamp at the front of the foot is connected in any suitable manner, as by stitching 17, to the moccasin upper 18. The upper 18 may be provided with any desired ornamental arrangement such as the front flap or tongue 20. The laces 15 wrap around the tongue and may be tied in a bow 21 after having been pulled tight. The toe section 13*e* of the vamp at the front of the moccasin is also secured to the upper 18, for instance, by the stitched seam 22. The material of which the vamp 11 is comprised may be shaped and stretched and thus may be of leather or similar material requiring only a seam or backstay 25 at the rear for completion.

An outer sole 30 is secured in a suitable manner, as by glue or stitching, to the vamp side portion 13*a*, 13*b*, 13*c* and 13*e*. The bottom 31 of the outer sole 30 is shaped to coincide with the general shape of the lower vamp surface 12 of the moccasin. The outer sole is preferably made of a material which is better able to withstand scuffing and wear than the material of which the continuous vamp 11 of the moccasin is made. The outer sole 30 is provided with integral upstanding side wals 32 which receive the vamp in a cup shaped arrangement, whereby the side walls 32 of the outer sole 30 may thus be in contact with the vamp and be secured thereto at 33. Such securement will be by stitching, adhesive, etc. The elements next described below are enclosed within the enclosure defined inside the bottom 31 of the outer sole, its side walls 32 and the underside 12 of the vamp 11.

A midsole 35 is placed over and may be secured, e.g. by adhesive, to the upper surface of the outer sole. The midsole has the shape of the lower vamp surface 12. The midsole 35 is thick and rigid enough to provide horizontal shape retention for the outer sole 30 and to provide structural strength for the bottom of the moccasin; so that a wearer will not feel normal irregularities of the ground, floor or walking surface.

In order to give the moccasin a comfortable feel as the wearer walks, a full length, cushion pad 40 extends from the front to the back of the moccasin. The cushion pad 40 is a foam rubber, resilient pad, which yields under foot pressure. Various materials for such a cushioned pad are noted above. The cushion pad 40 is placed over the midsole and beneath the bottom of the vamp and provides the wearer with more of the resilience, softness and feel than is normally expected from a moccasin.

To further increase wearer comfort and to elevate his heel so that the moccasin has the feel of a more normal shoe, a heel cushion pad 42 is provided atop the main cushion pad 40. Cushion pad 42 is skived at its forward end at 43 to provide the slight elevation at the heel to which the wearer is accustomed while nevertheless providing additional shock resistance at the heel and thereby increasing the comfort of the moccasin. The heel cushion pad has the same construction and characteristics as the main cushion 40.

Preferably, in the moccasin shown, the full cushion sole pad 40 is of the order of 12 mm thick and is made of cellular rubber or synthetic material having the same characteristics. Likewise, the heel cushion pad 42 is of the same or similar material as the full sole cushion pad 40 and of the same thickness. The cellular material may even have ruptured cells which communicate in a sponge-like manner and still provide desired comfort.

By this means, a moccasin is created which is structurally supported and shaped by the outer sole and the midsole and which at the least has all of the comfort ascribable to a moccasin. In order to retain the soft feel of the moccasin while the wearer walks over any texture of surface, despite the relatively rigid midsole, the full cushion pad above the midsole and the heel cushion pad above the full cushion pad are additionally provided. This provides a soft feel for the moccasin even though substantial reinforcement has been provided for the bottom of the moccasin by the outer sole and the midsole.

The present invention has been described in connection with a peferred illustrative embodiment thereof. Since many variations and modifications of the present invention will now become obvious to those skilled in the art, it is preferred that the scope of this invention be limited not by the specific disclosures herein contained but only by the appended claims.

What we claim is:

1. A moccasin comprising:

a continuous vamp comprising a lower section for extending over the entire lower surface of the foot, and integral upper side portions extending up from said lower section; an upper secured to the forward sectin of said upper side portions of said vamp;

a full outer sole; said outer sole having a side wall extending up to and engaging a portion of said side portions of said vamp;

a full length midsole having the profile shape of said vamp lower section; said midsole extending inside the enclosure defined inside said outer sole and beneath said vamp lower section for assisting in shaping and supporting said outer sole;

a full length cusion pad between said midsole and said vamp; and a heel cushion pad between said full length cushion pad and said vamp, whereby the shape and feel of a comfortable moccasin are maintained.

2. The moccasin of claim 1 wherein said full length cushion pad and said heel cushion pad are made of a resilient material.

3. The moccasin of claim 2, wherein said full length cushion pad and said heel cushion pad are of substantially equal thickness.

4. The moccasin of claim 3 in which said full length cushion pad and said heel cushion pad are each comprised of cellular material.

5. The moccasin of claim 3 in which said upper side portion of said vamp at the rear is finished off by a seam, and eyelets are provided in said upper side portion for reception of laces.

6. The moccasin of any of claims 2, 3 or 4, wherein said heel cushion pad is skived at the front thereof to provide a smooth transition to said full cushion pad.

* * * * *